US010486859B2

(12) United States Patent
Sudakoff

(10) Patent No.: US 10,486,859 B2
(45) **Date of Patent: *Nov. 26, 2019**

(54) COLLAPSIBLE FOOD CONTAINER

(71) Applicant: Wilshire Industries, LLC, San Clemente, CA (US)

(72) Inventor: Daniel A. Sudakoff, San Clemente, CA (US)

(73) Assignee: WILSHIRE INDUSTRIES, LLC, San Clemente, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/231,550

(22) Filed: Aug. 8, 2016

(65) Prior Publication Data

US 2017/0129649 A1 May 11, 2017

Related U.S. Application Data

(63) Continuation of application No. 14/798,329, filed on Jul. 13, 2015, now Pat. No. 9,409,677, which is a continuation of application No. 13/601,783, filed on Aug. 31, 2012, now Pat. No. 9,079,685.

(51) Int. Cl.

| | |
|---|---|
| ***B65D 21/08*** | (2006.01) |
| ***B65D 43/02*** | (2006.01) |
| ***B65D 51/16*** | (2006.01) |

(52) U.S. Cl.

CPC ..... *B65D 21/086* (2013.01); *B65D 43/0218* (2013.01); *B65D 51/1683* (2013.01); *B65D 2543/00092* (2013.01); *B65D 2543/0099* (2013.01); *B65D 2543/00101* (2013.01)

(58) Field of Classification Search

CPC ..... B65D 21/086; B65D 43/0218

USPC ..... 220/200, 367.1

See application file for complete search history.

(56) References Cited

U.S. PATENT DOCUMENTS

| | | | | |
|---|---|---|---|---|
| 5,417,337 | A | 5/1995 | Robbins, III | |
| 5,575,398 | A | 11/1996 | Robbins, III | |
| 5,900,293 | A | 5/1999 | Zettle | |
| 6,315,151 | B1 | 11/2001 | Hupp et al. | |
| 7,678,271 | B2 | 3/2010 | Curtin | |
| 8,313,000 | B1 * | 11/2012 | Tuan | B65D 21/086 220/573.1 |
| 2005/0127074 | A1 * | 6/2005 | Kusuma | B65D 21/086 220/6 |

(Continued)

FOREIGN PATENT DOCUMENTS

| | | |
|---|---|---|
| EP | 0 719 708 | 7/1996 |
| JP | 10-511912 | 11/1998 |

OTHER PUBLICATIONS

PCT International Search Report, PCT/US2013/057026, dated Dec. 6, 2013, 3 pages.

(Continued)

*Primary Examiner* — Anthony D Stashick
*Assistant Examiner* — Raven Collins
(74) *Attorney, Agent, or Firm* — Snell & Wilmer LLP

(57) ABSTRACT

The present specification discloses a collapsible food container. The container includes a wall portion with an outer surface having a substantially smooth shape. The wall portion is configured to bend from raised position to a collapsed position, with the food container being used to retain food in the raised position and being collapsed for storage in the collapsed position.

20 Claims, 11 Drawing Sheets

(56) References Cited

U.S. PATENT DOCUMENTS

| | | | | |
|---|---|---|---|---|
| 2006/0096929 | A1* | 5/2006 | Repp | A47J 19/00 210/740 |
| 2008/0099476 | A1 | 5/2008 | Fung | |
| 2011/0311688 | A1* | 12/2011 | Becraft | B65D 21/086 426/111 |

OTHER PUBLICATIONS

PCT Written Opinion of the International Searching Authority, PCT/US2013/057026, dated Dec. 6, 2013, 8 pages.
PCT Int'l Preliminary Report on Patentability, PCT/US2013/057026, dated Mar. 3, 2015, 9 pages.
Image of Colander, publicly available in year 2009, 1 page.
Images from website: http://www.smartplanethome.com/collections/meal-kits?page=1; products shown in webpages publicly available in year 2010, 50 pages.
Lékué; Lékué Collapsible Steamer, Pink, 2.5 Qt.; Printout from Wayback Machine entry for: http://web.archive.org/web/20120717021814/http://www.lekueusa.com/Collapsible-Steamer-Pink-2-5-qt--plu3400500R08U008.html; dated Jul. 17, 2012, 2 pages.
Lékué; Lékué Catalog; Printout from Wayback Machine entry for: http://web.archive.org/web/20130319074426/http://ctalog.lekueusa.com/catalog/Lekue-Catalog-2012.pdf, Printout of p. 1-2, 24-25, 30-31, and 102-103 of Catalog; dated Jun. 18, 2012, 7 pages.

* cited by examiner

COLLAPSIBLE FOOD CONTAINER

RELATED APPLICATIONS

This application is a continuation of U.S. patent application Ser. No. 14/798,329 entitled "COLLAPSIBLE FOOD CONTAINER" filed on Jul. 13, 2015, which is a continuation of U.S. patent application Ser. No. 13/601,783 entitled "COLLAPSIBLE FOOD CONTAINER" filed on Aug. 31, 2012, now U.S. Pat. No. 9,079,685, the entire contents of these applications are hereby incorporated by reference herein.

FIELD OF THE INVENTION

The present disclosure relates to a food container configured to collapse for storage.

BACKGROUND OF INVENTION

Containers for food storage may include various corrugations, hinges and accordion-like shapes that allow such containers to collapse for storage. However, such containers suffer from a series of limitations. For example, such containers typically lack structural strength and aesthetic appeal. Moreover, the various hinges and corrugations block the view of the user trying to view the contents of the food container. In addition, food may become jammed and trapped within the various hinges and corrugations, which may be difficult to remove, and may discourage use of the food container for sticky foods.

In addition, collapsible containers known in the art are typically molded in parts and then assembled together mechanically after molding. These assembly steps add to the expense of the containers. In addition, the assembly steps often produce creases in the containers that can trap food, and also decrease the structural strength of the containers.

It is thus desirable to produce a container for food storage that is able to collapse without use of these corrugations, hinges and accordion-like shapes, and is constructed in a simpler and more efficient manner.

SUMMARY OF THE INVENTION

Aspects of the present specification disclose a collapsible food container configured to collapse from a raised position to a collapsed position. The food container in the raised position is configured to retain food. The food container in the collapsed position is collapsed for storage.

The food container includes a wall portion that is configured to bend to move the food container from the raised position to the collapsed position. An outer surface of the wall portion has a substantially smooth shape, without any creases, ridges, or grooves therein. Thus, the wall portion bends from the raised position to the collapsed position without any evident hinges defined in the outer surface. The food container retains its structural strength, yet also allows its contents to be clearly visible through the smooth outer surface of the wall portion.

The food container may be manufactured such that the wall portion is molded integral with a base portion of the container. The integral mold reduces assembly costs of the food container and enhances the strength of the container. The integral mold also reduces joints in the interior of the container that may trap food.

BRIEF DESCRIPTION OF THE DRAWINGS

Features and advantages of the present invention will become appreciated as the same become better understood with reference to the specification, claims, and appended drawings wherein:

DETAILED DESCRIPTION OF THE PREFERRED EMBODIMENTS

Figure 1:
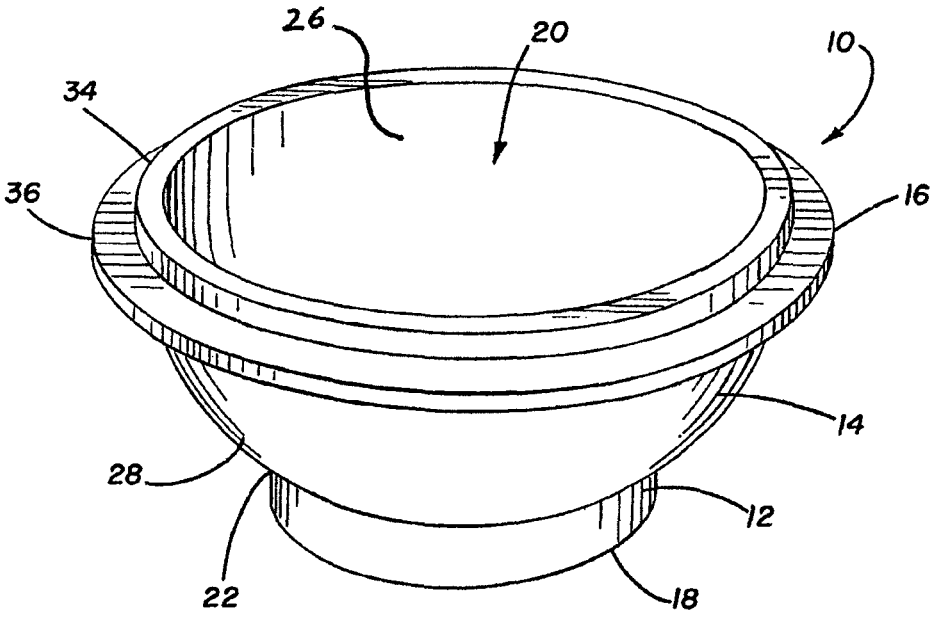
FIG. 1 illustrates a perspective view of a collapsible food container according to an embodiment of the present application.

FIG. 1 illustrates a perspective view of a collapsible food container 10 configured to collapse from a raised position, or first position, in which the container 10 is configured to retain food, to a collapsed position, or second position, in which the container 10 is collapsed for storage.

The collapsible food container 10 includes a base portion 12, a wall portion 14 and a rim 16. The base portion 12 forms the bottom of the food container 10. The base portion 12 is configured to stand upon a support surface to allow the food container 10 to rest upon the support surface. The base portion 12 may include a stand 18, which contacts the support surface to transmit the weight of the food container 10 to the support surface. In the embodiment shown in FIG.

1, the stand 18 forms a cylindrical shaped structure that extends vertically upward in a direction towards the top of the food container 10.

The wall portion 14 extends upward from the base portion 12. The wall portion 14 surrounds and defines an interior cavity 20 of the food container 10 configured to receive food for storage or other desired purposes. The wall portion 14 is joined to the base portion 12 at a lower end 22 of the wall portion 14. The wall portion 14 extends upward from the lower end 22 to terminate in an open upper end 24 (more clearly shown in FIG. 2). The wall portion 14 has an inner surface 26 and an outer surface 28. The inner surface 26 faces the interior cavity 20 and surrounds the interior cavity 20. The outer surface 28 faces opposite the interior cavity 20. The outer surface 28 preferably has a substantially smooth shape, which does not have any creases, ridges, or grooves. The substantially smooth shape of the outer surface 28 increases the aesthetic appeal of the food container 10, and also allows the contents of the food container 10 to be more easily seen through the wall portion 14.

Figure 3:
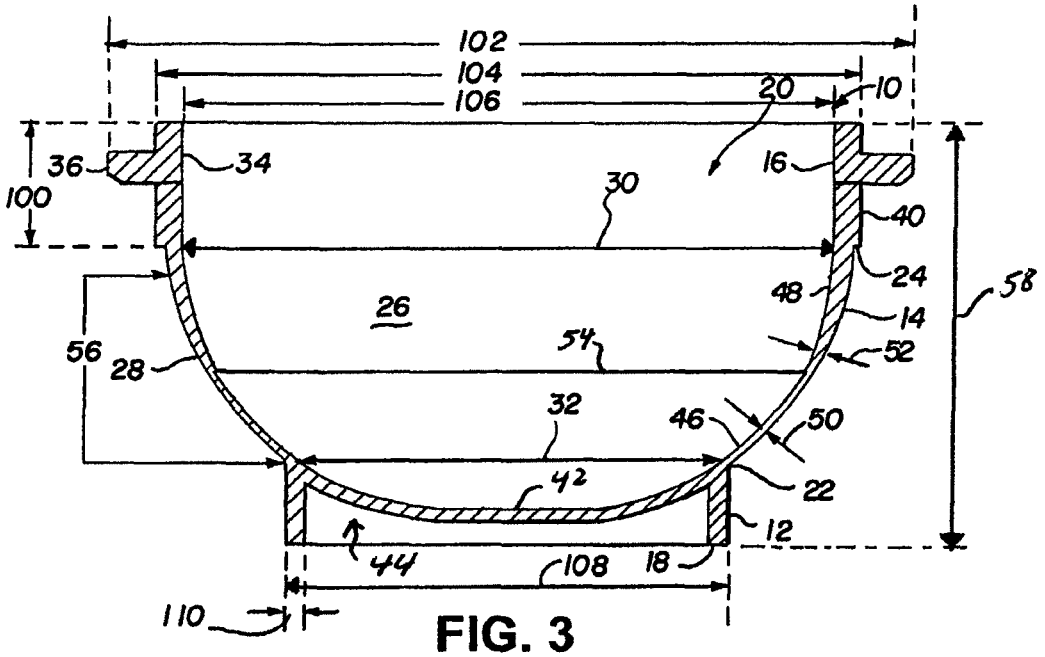
FIG. 3 illustrates a cross sectional view of the collapsible food container that is shown in FIG. 1.

The wall portion 14 also preferably has a downward convex curvature, with a diameter 30 of the upper end 24 of the wall portion 14 being greater than a diameter 32 of the lower end 22 of the wall portion 14 (more clearly shown in FIG. 3). The downward convex curvature allows the food container 10 to be more easily stacked with other similar food containers if desired. The substantially smooth shape of the outer surface 28 also allows the food container 10 to be more easily stacked with other similar food containers because any creases in the outer surface need not be aligned for stacking.

The rim 16 is positioned above the wall portion 14 and includes a vertically extending mating portion 34 and an outwardly extending flange 36. The mating portion 34 is configured to mate with a lid 38 shown in FIG. 9. The outwardly extending flange 36 provides rigidity for the food container 10 and a grip point for a user applying or removing the lid 38.

Figure 2:
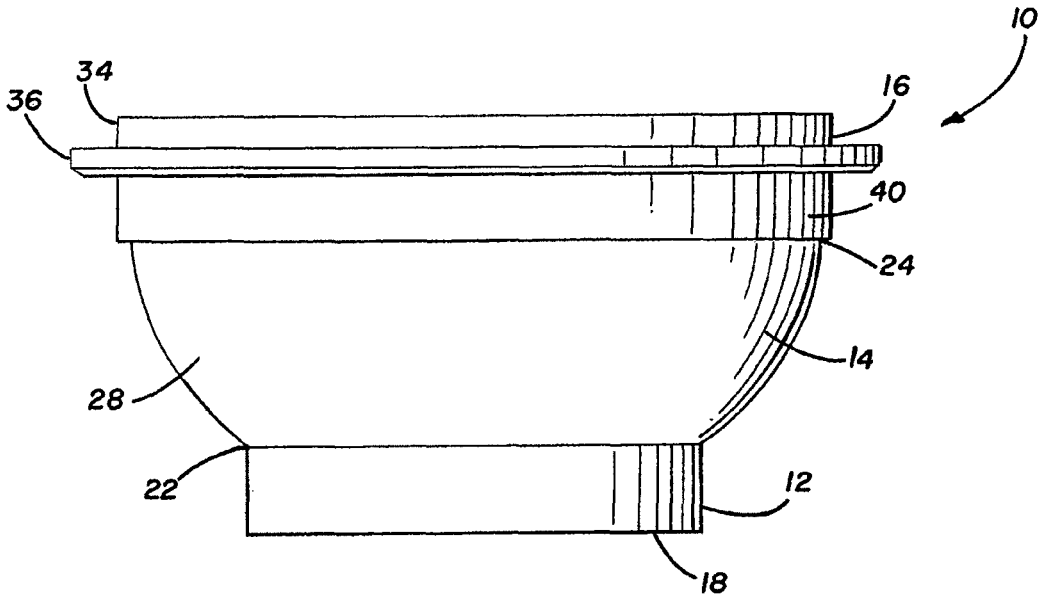
FIG. 2 illustrates a side view of the collapsible food container that is shown in FIG. 1.

FIG. 2 illustrates a side view of the food container 10 shown in FIG. 1. FIG. 2 illustrates the rim 16 connects to the wall portion 14 through a rim support 40. The rim support 40 is positioned at the upper end 24 of the wall portion 14 and joins the upper end 24 of the wall portion 14 to the rim 16. In the embodiment shown in FIG. 2, the rim support 40 comprises a cylindrical portion of the food container 10 that extends outward from the container 10 further than the wall portion 14.

FIG. 3 illustrates a cross sectional view of the food container 10 taken along a midline of the container 10. FIG. 3 illustrates the base portion 12 defines the bottom 42 of the food container 10. In the embodiment shown in FIG. 3, the bottom 42 of the food container 10 comprises a substantially flattened portion for food to rest upon when placed in the interior cavity 20. FIG. 3 also illustrates the stand 18 of the base portion 12 surrounds an interior cavity 44 positioned beneath the bottom 42 of the base portion 12.

FIG. 3 illustrates the wall portion 14 is made of a material having at least two thicknesses. A first portion 46 of the wall portion 14 extends upward from the lower end 22. A second portion 48 of the wall portion 14 extends upward from the first portion 46. The first portion 46 has a thickness 50 that is less than the thickness 52 of the second portion 48. The thickness 50 of the first portion 46 transitions to the thickness 52 of the second portion 48 at a transition that forms a ridge 54 in the inner surface 26 of the wall portion 14. Thus, the inner surface 26 of the wall portion 14 is not smooth at the transition. In contrast, the outer surface 28 of the wall portion 14 remains smooth at the transition. The inner surface 26 of the wall portion 14, however, is smooth along the surface of the first portion 46, and is smooth along the surface of the second portion 48.

The varied thickness of the wall portion 14 allows the wall portion 14 to collapse in a desired manner. The wall portion 14 includes a flexible portion 56, which generally lies between the lower end 22 of the wall portion 14 and a point slightly below the upper end 24 of the wall portion 14. The flexible portion 56 is configured to bend, to allow the food container 10 to collapse from the height 58 shown in FIG. 3 to the lower height 60 shown in FIG. 8. The height of the wall portion 14 varies correspondingly. The flexible portion 56 preferably includes the first portion 46 and second portion 48 of the wall portion 14.

Figure 4:
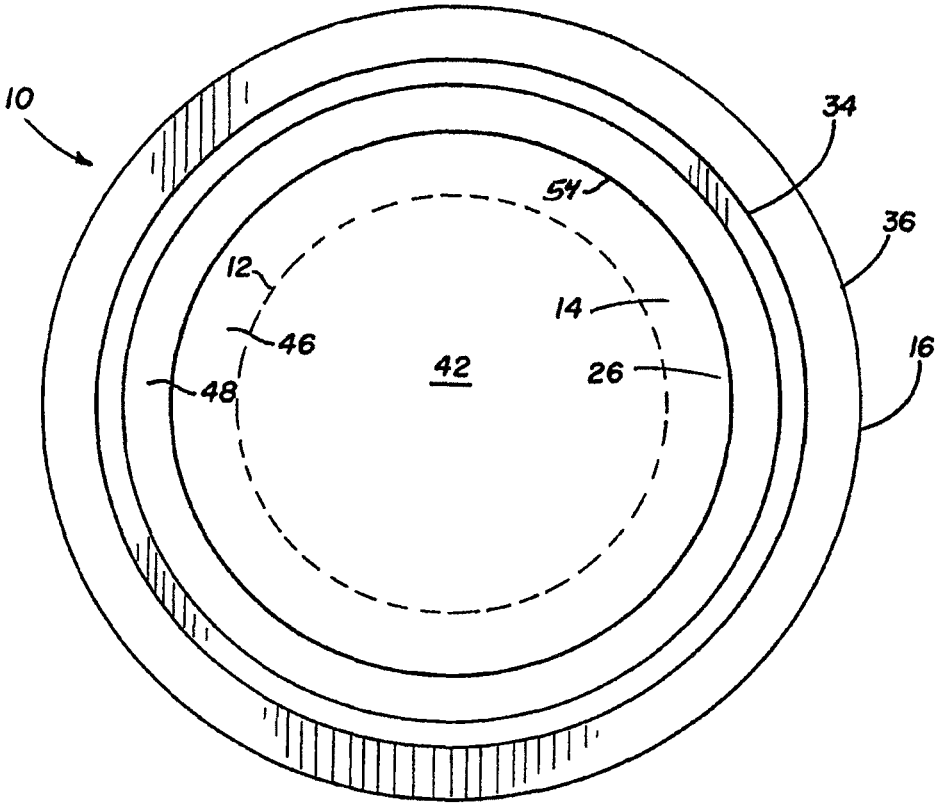
FIG. 4 illustrates a top view of the collapsible food container that is shown in FIG. 1.

FIG. 4 illustrates a top view of the food container 10 shown in FIGS. 1, 2 and 3. The position of the base portion 12 is shown in dashed lines relative to the wall portion 14 extending upward therefrom.

Figure 5:
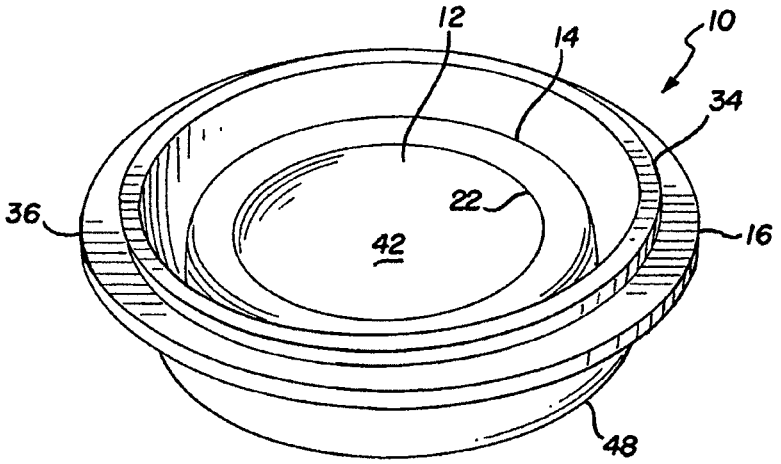
FIG. 5 illustrates a perspective view of the collapsible food container of FIG. 1, in a collapsed position.

FIG. 5 illustrates a perspective view of the food container 10 collapsed from the position shown in FIG. 1. In the collapsed position of the food container, the flexible portion 56 of the wall portion 14 shown in FIG. 3 has been bent to allow the food container 10 to have a reduced height.

Figure 6:
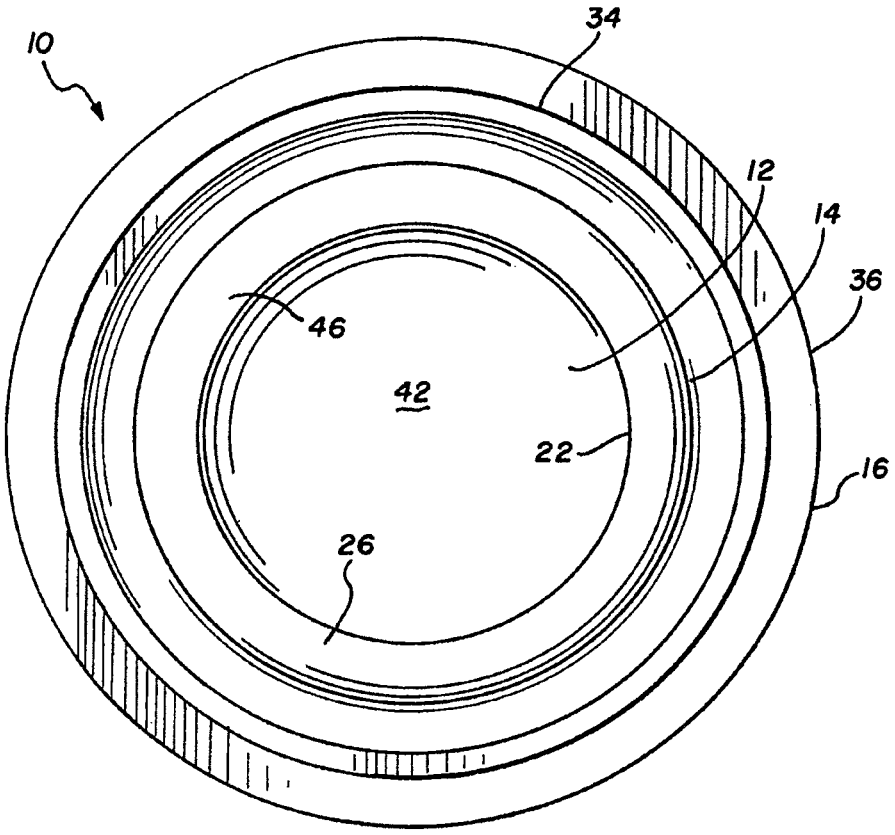
FIG. 6 illustrates a top view of the collapsible food container of FIG. 5, in the position shown in FIG. 5.

FIG. 6 illustrates a top view of the food container 10 in the collapsed position shown in FIG. 5.

Figure 7:
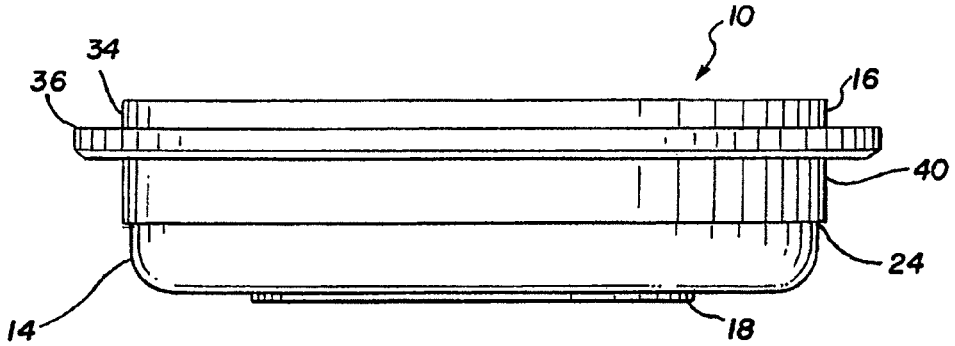
FIG. 7 illustrates a side view of the collapsible food container of FIG. 5, in the position shown in FIG. 5.

FIG. 7 illustrates a side view of the food container 10 in the collapsed position shown in FIGS. 5 and 6.

Figure 8:
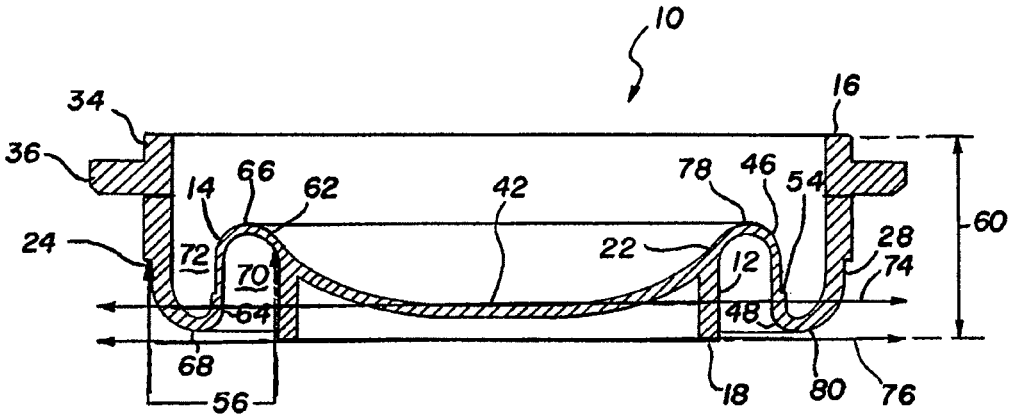
FIG. 8 illustrates a cross sectional view of the collapsible food container of FIG. 5, in the position shown in FIG. 5.

FIG. 8 illustrates a cross sectional view of the food container 10 in the collapsed position shown in FIGS. 5-7, and taken along the same midline of the container 10 as in FIG. 3. FIG. 8 illustrates the flexible portion 56 of the wall portion 14 has bent to reduce the height 60 of the food container 10 from the height 58 shown in FIG. 3. Preferably, the flexible portion 56 bends to form an upward convex curvature portion 62 adjacent to a downward convex curvature portion 64. The upward convex curvature portion 62 curves starting at the lower end 22 of the wall portion 14 and extends upward to a maximum 66 of the convex curve upward section 62. The upward convex curvature portion 62 then transitions to the downward convex curvature portion 64 which has a minimum 68. The downward convex curvature portion 64 then extends upward to the upper end 24 of the wall portion 14. The maximum 66 of the convex curve upward section 62 is made of the first portion 46 of the wall portion 14, having a thickness 50 shown in FIG. 3. The minimum 68 of the downward convex curvature portion 64 is made of the second portion 48 of the wall portion 14, having a thickness 52 shown in FIG. 3. The ridge 54 defining the transition between the first portion 46 and the second portion 48 lies between the upward convex curvature portion 62 and the downward convex curvature portion 64.

The bend of the flexible portion 56 forms two cavities 70, 72, with the outer cavity 72 encircling the inner cavity 70. In addition, the bend of the flexible portion 56 causes the wall portion 14 to encircle a portion of itself, for example, the upper end 24 of the wall portion 14 in the collapsed position encircles the lower end 22 of the wall portion 24. In addition, the bend of the flexible portion 56 causes the wall portion 14 to be lowered, and to pass through a plane 74 (represented in two-dimensional form by plane line 74) that the container bottom 42 extends along. However, the bend does not lower the wall portion 14 to cause the wall portion 14 to pass through the plane 76 (represented in two-dimensional form by plane line 76) defined by the contact surface of the stand 18 that contacts the support surface. Thus, the food container 10 may rest upon the stand 18 even if the flexible portion 56 of the food container 10 is bent to a collapsed position.

The flexible portion 56 is capable of folding due in part to the first portion 46 of the wall portion 14 that is thinner than the second portion 48 of the wall portion 14. The first portion 46 is flexible and configured to bend. The thinner first portion 46 defines a weaker portion of the wall portion 14, which will bend first when downward pressure is applied to the food container 10. The base portion 12, however, is not made of material as thin as the first portion 46, and therefore does not bend when downward pressure is applied. Downward pressure applied to the wall portion 14 therefore causes the flexible portion 56 to bend about bend portions 78, 80 which serve as pivot points or hinge points that the flexible portion 56 bends about. In the embodiment shown in FIG. 8, bend portions 78, 80 are respectively about the maximum 66 and minimum 68 of the flexible portion 56. Other parts of the flexible portion 56 that the flexible portion 56 bends about also serve as bend portions. The bend portions 78, 80 are able to serve as pivot points for the flexible portion 56 even though the outer surface 28 of the wall portion 14 has a smooth shape.

To return the food container 10 back to the raised position shown in FIG. 1, upward force is applied to the flexible portion 56 to return it back into place. The flexible portion 56 therefore bends about the bend portion 78, 80 between a raised position, or first position, in which the wall portion 14 has a height corresponding to height 58 shown in FIG. 3, and a collapsed position, or second position, in which the wall portion 14 has a height corresponding to height 60 shown in FIG. 8. In addition, the first portion 46 and second portion 48 are each configured to bend between the raised position and the collapsed position.

The bend of the flexible portion 56 beneficially allows the food container 10 to collapse for easy storage of the container. A user may simply press down on the top of the food container 10 to bend the flexible portion 56 to the position shown in FIG. 8. The smooth shape of the outer surface 28 of the wall portion 14, without any creases, grooves, notches, or evident hinges, enhances the aesthetic and functional appeal of the container 10, by allowing an external user to more easily see into the container 10. In addition, the downward convex curvature of the wall portion 14 reduces the total size of the food container 10 in the collapsed position, because the outermost portions of the wall portion 14 may wrap around the innermost portions when collapsed. Further, the inner surface of the first portion 46 and second portion 48 is smooth, which reduces the chance of sticky food from becoming trapped or stuck in grooves or creases of the inner surface of the first portion 46 and second portion 48.

Figure 9:
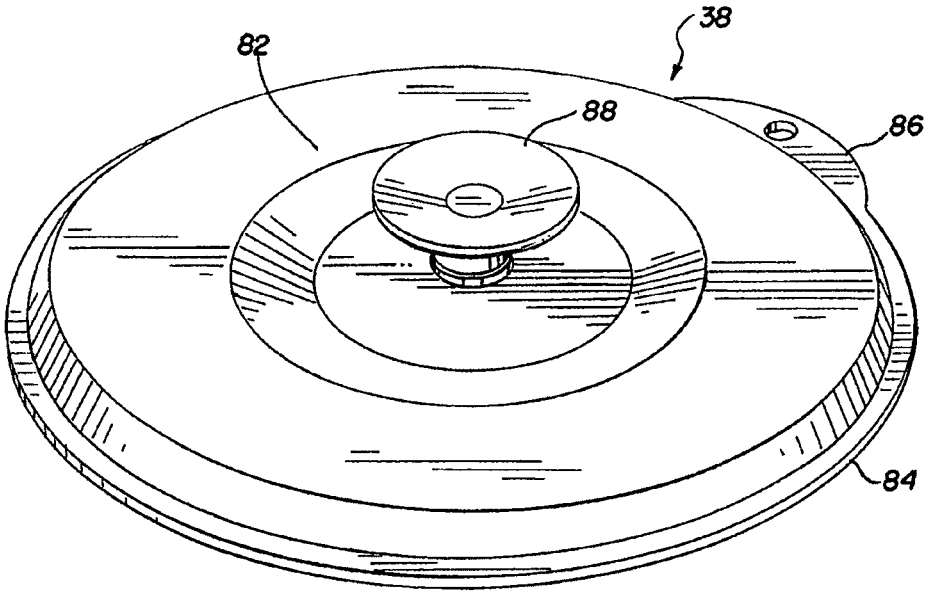
FIG. 9 illustrates a top perspective view of a lid according to an embodiment of the present application.

FIG. 9 illustrates a top perspective view of a lid 38 for placement on top of the wall portion 14 shown in FIG. 1, for example. The lid 38 includes a top plate 82 and an outer flange 84 at the periphery of the top plate 82. A lip 86 extends from the outer flange 84. The lip 86 is configured for a user to grab, to easily remove the lid 38 from the wall portion 14.

A vent 91 (shown in FIG. 14) extends through the top plate 82. The vent 91 allows air or steam to exit through the vent 91, if the food container 10 were used as a microwave steamer for example.

A vent plug 88 extends through and fills the vent 91. The vent plug 88 is configured to be slid within the vent 91 between a closed position and an open position, with the vent plug 88 in the closed position preventing air or steam from exiting through the vent 91, and the vent plug 88 in the open position allowing air or steam to exit through the vent 91.

Figure 10:
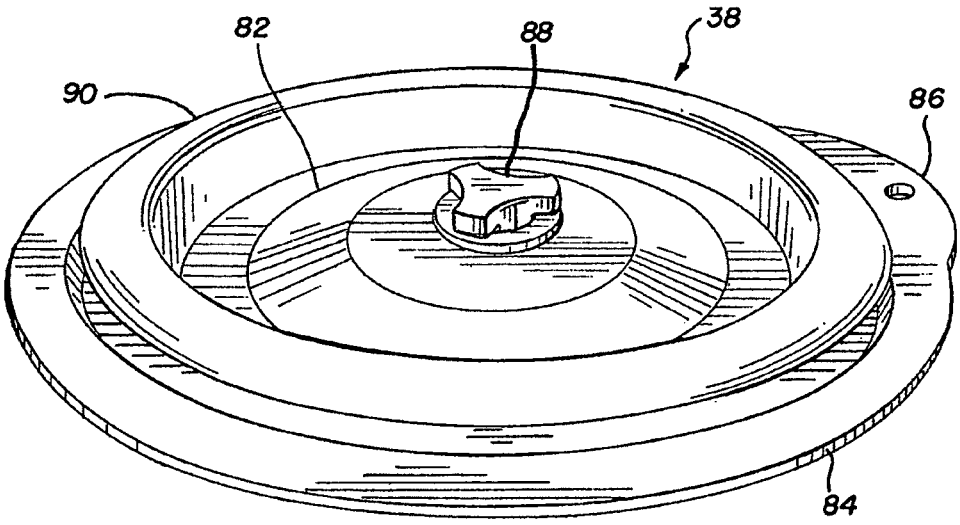
FIG. 10 illustrates a bottom perspective view of the lid that is shown in FIG. 9.

FIG. 10 illustrates a bottom perspective view of the lid 38. An air seal portion 90 of the lid 38 extends downward from the top plate 82. The air seal portion 90 of the lid 38 includes a flexible lip portion that mates with the rim 16 and flexes to form an air-tight seal with the rim 16 of the food container 10 (shown in FIG. 1).

Figure 11:
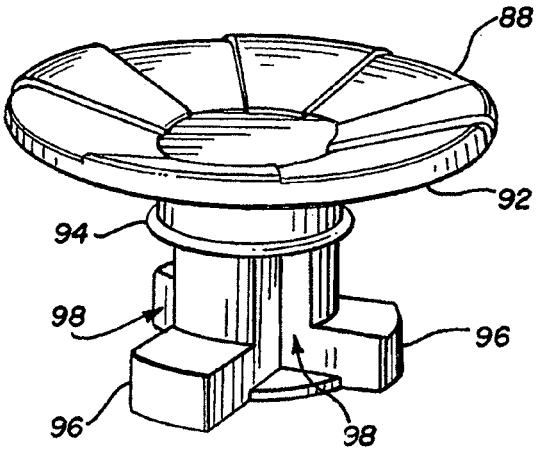
FIG. 11 illustrates a perspective view of the vent plug that is shown in FIG. 9.

FIG. 11 illustrates a perspective view of the vent plug 88. The vent plug 88 includes a grip flange 92, a seal flange 94, legs 96, and slots 98. The grip flange 92 extends outward from the top of the vent plug 88, and is configured to be gripped by a user. The grip flange 92 may be gripped so that a user may move the vent plug 88 between the open or closed position. The seal flange 94 extends outward from a middle of the vent plug 88, and is configured to press against a portion of the top plate 82 in the closed position, to prevent air or steam from exiting through the vent 91. The legs 96 extend outward from the bottom of the vent plug 88, and are divided by the slots 98. The legs 96 prevent a user from pulling the vent plug 88 entirely out of the vent 91. The slots 98 provide channels for air or steam to exit through the vent 91 when the vent plug 88 is in the open position.

Figure 12:
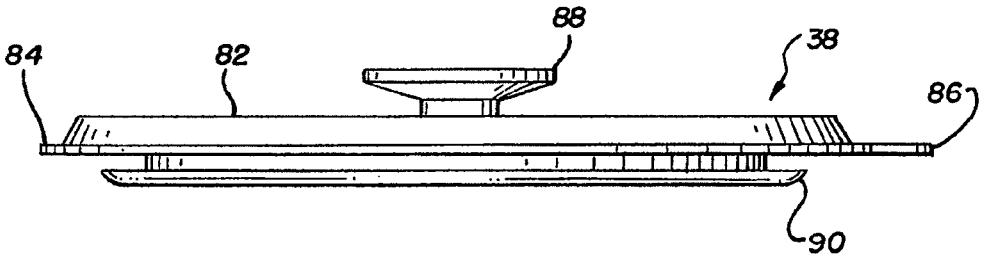
FIG. 12 illustrates a side view of the lid that is shown in FIG. 9.

FIG. 12 illustrates a side view of the lid 38.

Figure 13:
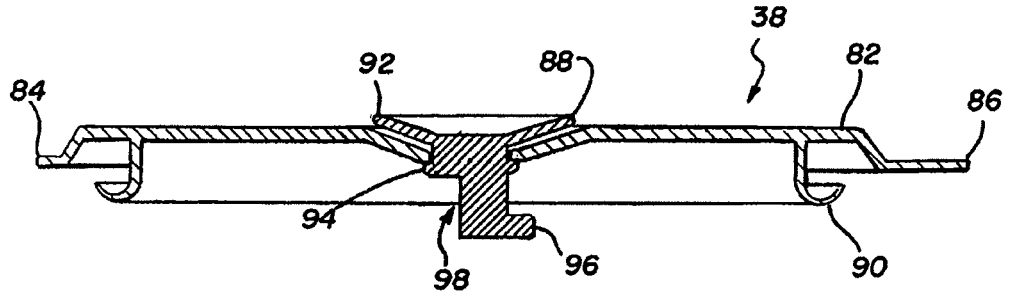
FIG. 13 illustrates a cross sectional view of the lid that is shown in FIG. 9.

FIG. 13 illustrates a cross sectional view along a midline of the lid 38. The air seal portion 90 of the lid 38 is visible extending downward from the top plate 82. The flexible lip portion of the air seal portion 90 is also visible curling upward. In the configuration shown in FIG. 13, the vent plug 88 is in the closed position, such that the seal flange 94 presses against the top plate 82.

Figure 14:
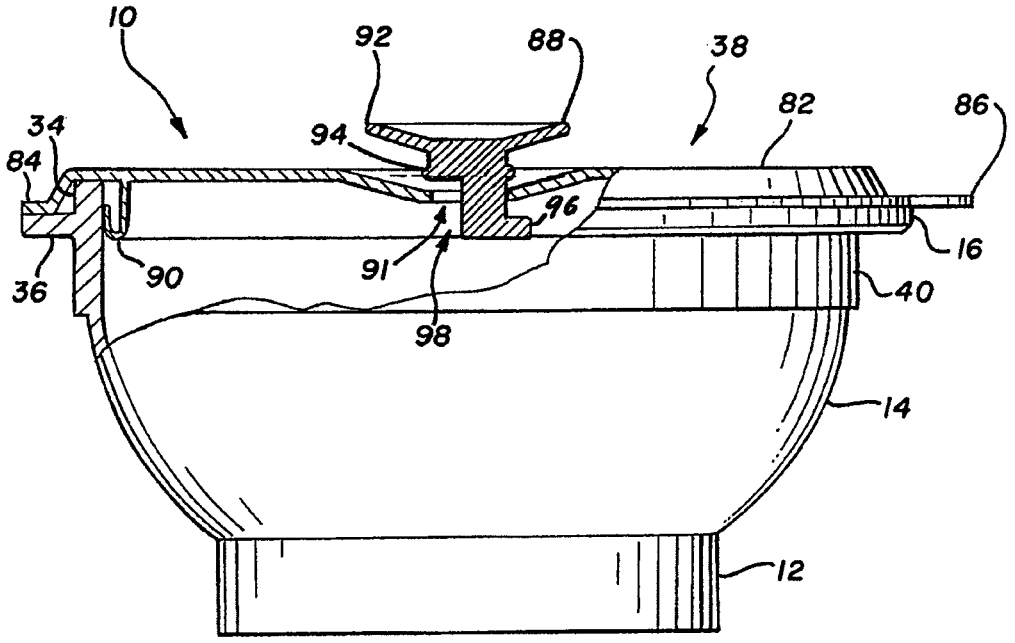
FIG. 14 illustrates a cut away view of the lid shown in FIG. 9 upon the collapsible food container shown in FIG. 1.

FIG. 14 illustrates a cut away side view of the lid 38 joined to the rim 16 of the food container 10. The outer flange 84 of the lid 38 fits against the outwardly extending flange 36 of the rim 16. The air seal portion 90 of the lid 38 flexes upward against the mating portion 34 of the rim 16, to form an air seal with the rim 16. The vent plug 88 is in the open position, which allows air or steam to exit through the vent 91 via the slots 98.

If the lid 38 forms an air seal with the rim 16, and the vent plug 88 is in the closed position, then air is prevented from exiting or entering the interior of the food container 10. Accordingly, with the lid 38 in place in this configuration, the food container 10 cannot be collapsed from the raised position shown in FIGS. 1-4, to the collapsed position shown in FIGS. 5-8, because the air within the food container 10 cannot exit to account for the reduced internal volume of the food container 10. In addition, if the lid 38 forms an air seal with the rim 16, and the vent plug 88 is in the closed position when the food container 10 is in the collapsed position shown in FIGS. 5-8, then the food container 10 cannot be raised to the raised position shown in FIGS. 1-4, because air cannot enter the food container 10 to account for the increased internal volume of the food container 10. The lid 38 serves as a stopper, to prevent the food container 10 from inadvertently being converted between the raised or collapsed position.

Figure 15:
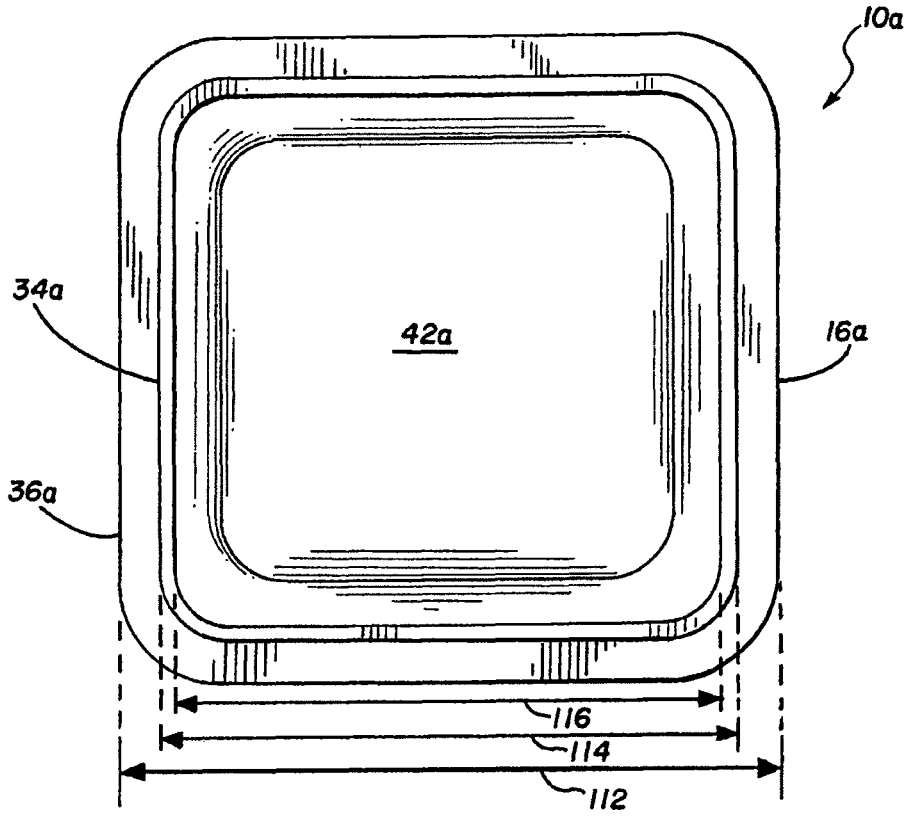
FIG. 15 illustrates a top view of a collapsible food container according to an embodiment of the present application.
Figure 16:
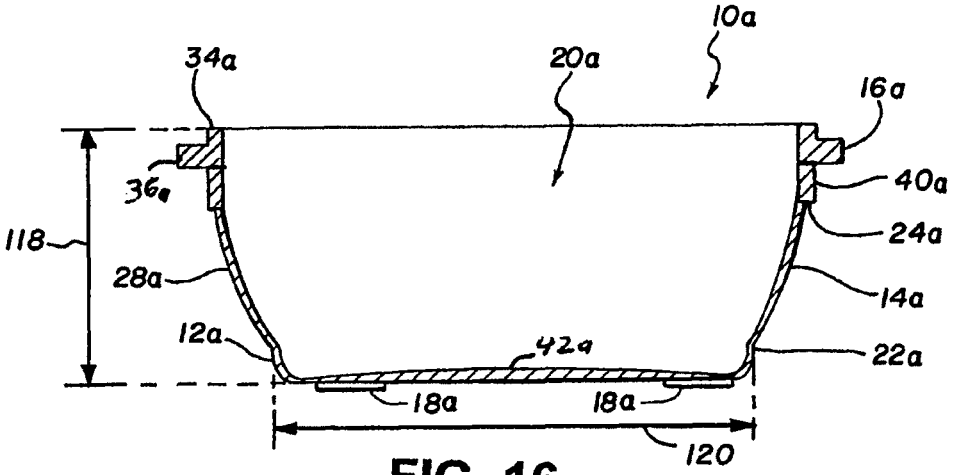
FIG. 16 illustrates a cross sectional view of the collapsible food container that is shown in FIG. 15.
Figure 17:
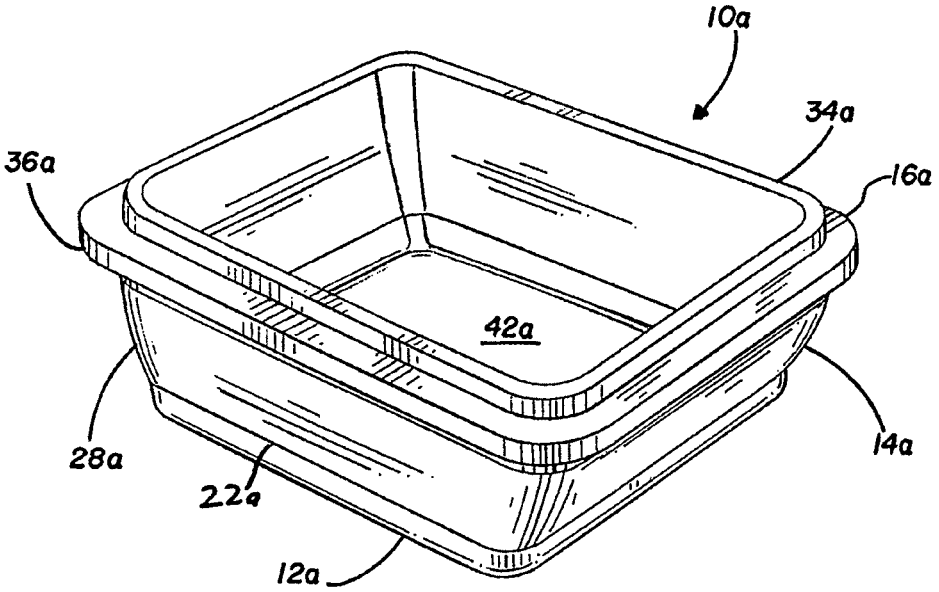
FIG. 17 illustrates a perspective view of the collapsible food container that is shown in FIG. 15.

FIGS. 15-17 illustrate an embodiment of the collapsible food container **10*a* having a square shape. Each side of the food container 10*a* has an approximately equal length. FIG. 15 illustrates a top view of the food container 10*a* in which the rim 16*a* of the food container 10*a* is shown including the vertically extending mating portion 34*a* and the outwardly extending flange 36*a*. The bottom 42*a* of the food container 10*a*** is also shown.

FIG. 16 illustrates a cross sectional view of the collapsible food container 10*a* along a midline of the container 10*a*. The parts of the food container 10*a* function similarly as the parts of the food container 10 discussed in regard to FIGS. 1-8, unless stated otherwise. For example, the stand 18*a* of the base portion 12*a* comprises small feet that extend downward from the bottom 42*a* of the food container 10*a*. The food container 10*a* includes the wall portion 14*a* that has an outer surface 28*a* with a substantially smooth shape, which does not have any creases, ridges, or grooves. The wall portion 14*a* extends from the base portion 12*a* from the lower end 22*a* of the wall portion 14*a* up to the upper end 24*a* of the wall portion 14*a*. The rim support 40*a* joins the upper end 24*a* of the wall portion 14*a* to the rim 16*a*. The wall portion 14*a* has a downward convex curvature shape, with a diameter of the upper end 24*a* of the wall portion 14*a* being greater than a diameter of the lower end 22*a* of the wall portion 14*a*.

The wall portion 14*a* of the collapsible food container 10*a* includes a flexible portion, similar to the flexible portion 56 discussed in regard to the collapsible food container 10 of FIGS. 1-8. Thus, the collapsible food container 10*a* may fold downward to a collapsed position in which the height of the collapsible food container 10*a* is reduced. The collapsible food container 10*a* folds in a similar manner as discussed in regard to the collapsible food container 10 of FIGS. 1-8.

FIG. 17 illustrates a perspective view of the collapsible food container 10*a* having a square shape.

Figure 18:
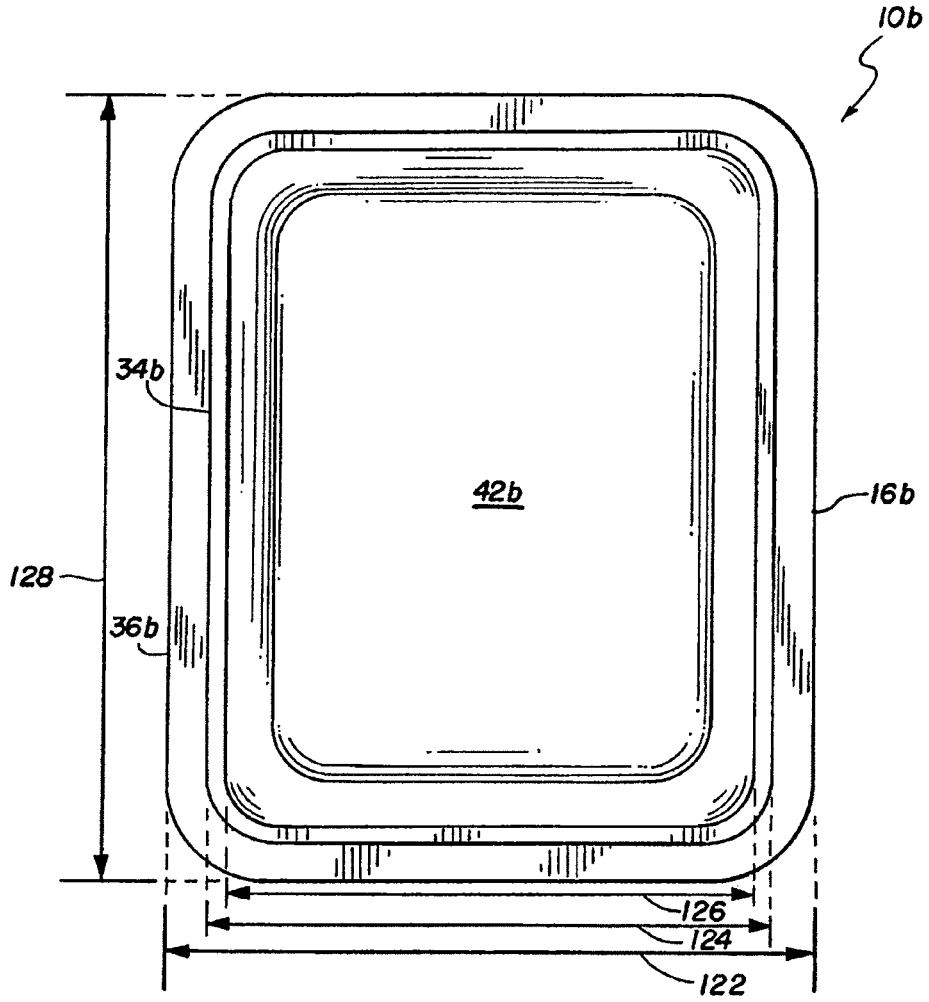
FIG. 18 illustrates a top view of a collapsible food container according to an embodiment of the present application.
Figure 19:
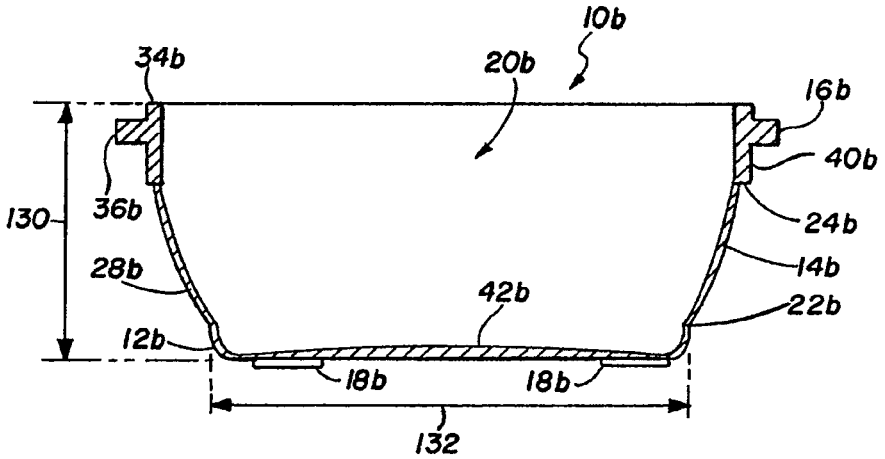
FIG. 19 illustrates a cross sectional view of the collapsible food container that is shown in FIG. 18.
Figure 20:
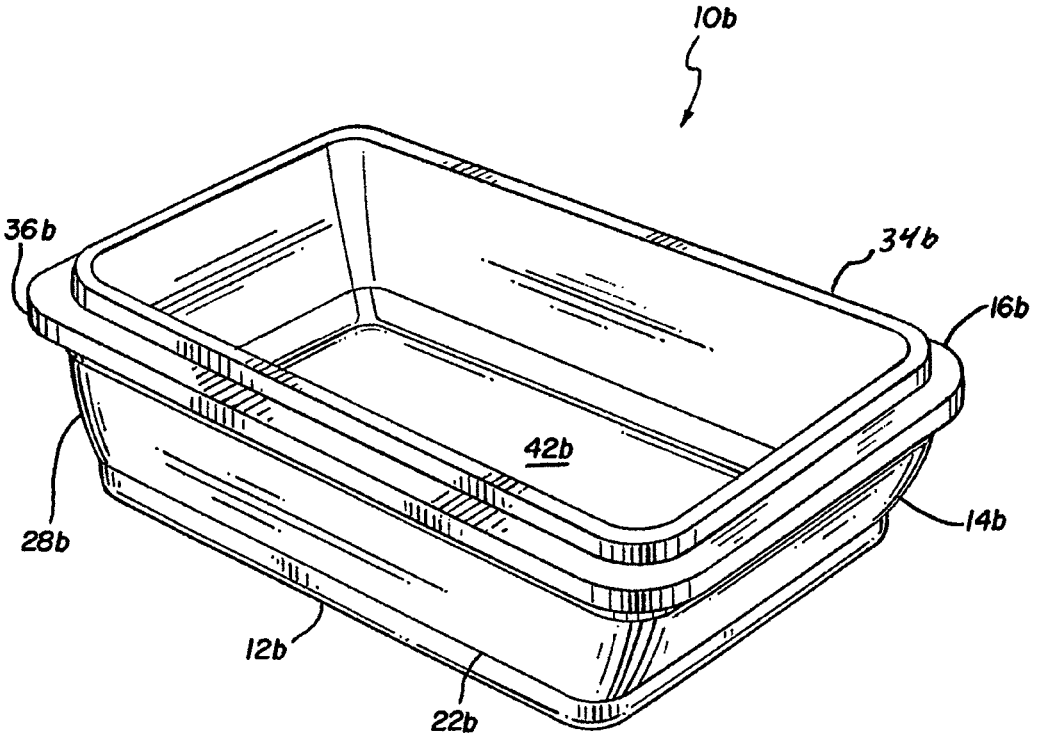
FIG. 20 illustrates a perspective view of the collapsible food container that is shown in FIG. 18.

FIGS. 18-20 illustrate an embodiment of the collapsible food container 10*b* having a rectangular shape. Opposing sides of the food container 10*b* have an approximately equal length. FIG. 18 illustrates a top view of the food container 10*b* in which the rim 16*b* of the food container 10*b* is shown including the vertically extending mating portion 34*b* and the outwardly extending flange 36*b*. The bottom 42*b* of the food container 10*b* is also shown.

FIG. 19 illustrates a cross sectional view of the collapsible food container 10*b* along a midline of the container 10*b*. The parts of the food container 10*b* function similarly as the parts of the food container 10 discussed in regard to FIGS. 1-8, unless stated otherwise. For example, the stand 18*b* of the base portion 12*b* comprises small feet that extend downward from the bottom 42*b* of the food container 10*b*. The food container 10*b* includes the wall portion 14*b* that has an outer surface 28*b* with a substantially smooth shape, which does not have any creases, ridges, or grooves. The wall portion 14*b* extends from the base portion 12*b* from the lower end 22*b* of the wall portion 14*b* up to the upper end 24*b* of the wall portion 14*b*. The rim support 40*b* joins the upper end 24*b* of the wall portion 14*b* to the rim 16*b*. The wall portion 14*b* has a downward convex curvature shape, with a diameter of the upper end 24*b* of the wall portion 14*b* being greater than a diameter of the lower end 22*b* of the wall portion 14*b*.

The wall portion 14*b* of the collapsible food container 10*b* includes a flexible portion, similar to the flexible portion 56 discussed in regard to the collapsible food container 10 of FIGS. 1-8. Thus, the collapsible food container 10*b* may fold downward to a collapsed position in which the height of the collapsible food container 10*b* is reduced. The collapsible food container 10*b* folds in a similar manner as discussed in regard to the collapsible food container 10 of FIGS. 1-8.

FIG. 20 illustrates a perspective view of the collapsible food container 10*b* having a rectangular shape.

In an embodiment, the collapsible food containers 10*a*, 10*b* shown in FIGS. 15-20 may be fitted with lids that provide similar function as the lid 38 discussed in regard to FIGS. 9-14. The lids of the collapsible food containers 10*a*, 10*b* shown in FIGS. 15-20, however, may be sized square or rectangular as desired to fit the respective food containers 10*a*, 10*b*.

Each of the food containers 10, 10*a*, 10*b* provides the benefit of a smooth outer surface of a wall portion 14, 14*a*, 14*b* that enhances the aesthetic and functional appeal of the container 10, 10*a*, 10*b* by allowing an external user to more easily see into the container 10, 10*a*, 10*b*. The food containers 10, 10*a*, 10*b* may be used in a variety of implementations, from short term food storage in which food is temporarily kept in the containers 10, 10*a*, 10*b* (during cooking for example) to long term food storage in which food is kept in the containers 10, 10*a*, 10*b* for extended periods of time. In one embodiment, any of the food containers 10, 10*a*, 10*b* may be used as a colander, if holes are placed in the bottom of the container 10, 10*a*, 10*b*. In addition, the food containers 10, 10*a*, 10*b* may have wall portions 14, 14*a*, 14*b* that are shaped as desired, and are not limited to the dome-like shape shown in FIGS. 1-4 or the pyramidal shapes shown in FIGS. 15-17 (square pyramidal) and FIGS. 18-20 (rectangular pyramidal).

Exemplary dimensions for the containers 10, 10*a*, 10*b* are intended to be non-limiting. Referring to the container 10 shown in FIG. 3, the height 58 of the container 10 in the raised position may range between approximately 66 and 74 millimeters. The height 100 of the bottom of the rim support 40 to the top of the rim 16 may range between approximately 18 and 22 millimeters. The width 102 of the rim 16 may range between approximately 128 and 162 millimeters. The width 104 of the mating portion 34 of the rim 16 may range between approximately 114 and 148 millimeters. The inner diameter 106 of the rim 16 may range between 106 and 140 millimeters. The width 108 of the base portion 12 may range between 76 and 110 millimeters. The width 110 of the stand 18 may range between approximately 3 and 5 millimeters.

Referring to the container 10*a* shown in FIG. 15, the width 112 of the rim 16*a* may range between approximately 134 and 176 millimeters. The width 114 of the mating portion 34*a* of the rim 16*a* may range between approximately 112 and 154 millimeters. The inner diameter 116 of the rim 16*a* may range between 102 and 144 millimeters. Referring to FIG. 16, the height 118 of the container 10*a* in the raised position may range between approximately 62 and 70 millimeters. The width 120 of the base portion 12*a* may range between 86 and 113 millimeters.

Referring to the container 10*b* shown in FIG. 18, the width 122 of the short end of the rim 16*b* may range between approximately 134 and 176 millimeters. The width 124 of the short end of the mating portion 34*b* of the rim 16*b* may range between approximately 112 and 154 millimeters. The inner short diameter 126 of the rim 16*b* may range between 102 and 144 millimeters. The width 128 of the long end of the rim 16*b* may range between approximately 180 and 220 millimeters. Referring to FIG. 19, the height 130 of the container 10*b* in the raised position may range between approximately 68 and 74 millimeters. The width 132 of the short end of the base portion 12*a* may range between 86 and 113 millimeters.

Any of the embodiments of the food container 10, 10*a*, 10*b* may be constructed in the following manner. The food containers 10, 10*a*, 10*b* are preferably formed from a single molding process in which the base portions 12, 12*a*, 12*b* are molded integral with the respective wall portions 14, 14*a*, 14*b*. The single molding process allows the base portions 12, 12*a*, 12*b* to not need to be joined to the respective wall portions 14, 14*a*, 14*b* in a separate manufacturing step. The integral mold reduces the time and expense of the manufacturing process.

The rim supports 40, 40*a*, 40*b* are also preferably molded integral with the respective wall portions 14, 14*a*, 14*b* and base portions 12, 12*a*, 12*b*. The rims 16, 16*a*, 16*b* however, are preferably molded separate from the respective rim supports 40, 40*a*, 40*b* and are later joined to the rim supports 40, 40*a*, 40*b* with an adhesive. The adhesive is preferably silicone, but any other form of adhesive may be used as desired.

The lid 38 shown in FIGS. 9-14 may be molded integrally, with the vent plug 88 being molded separate and later pressed into the vent 91 in a separate manufacturing step. A lid configured to be fit on the collapsible food containers 10*a*, 10*b* shown in FIGS. 15-20 may be constructed in a similar manner as the lid 38.

Preferably, the food containers 10, 10*a*, 10*b* are made of silicone. The silicone material provides sufficient strength to support the food container 10, 10*a*, 10*b* in the raised position, but also provides sufficient flexibility to allow the food container 10, 10*a*, 10*b* to bend and collapse to the collapsed position. In addition, the silicone material has a generally low toxicity, to allow it to contact food and store food. Preferably, all components of the food containers 10, 10*a*, 10*b*, including lids that fit on the food containers, are made of silicone. In addition, the silicone used for the wall portion 14, 14*a*, 14*b* and the base portions 12, 12*a*, 12*b* is preferably configured to allow objects to be visible within the respective food container 10, 10*a*, 10*b*. These parts are made of silicone that is transparent or translucent, to allow objects to be visible within the respective food container 10, 10*a*, 10*b*. In addition, preferably, the rims 16, 16*a*, 16*b* are made of a colored silicone that is colored different than the respective wall portions 14, 14*a*, 14*b* and base portions 12, 12*a*, 12*b*. The colored rims 16, 16*a*, 16*b* allow the user to more easily identify and remember the contents of the respective food container 10, 10*a*, 10*b* based on the color of the rim 16, 16*a*, 16*b*.

A method of manufacture for the food containers 10, 10*a*, 10*b* generally includes the step of providing a mold for the food container 10, 10*a*, 10*b*. The method also includes the step of filling the mold with the desired material for the food containers 10, 10*a*, 10*b*, which is preferably silicone. The desired shape for the food container 10, 10*a*, 10*b* results. Preferably, the base portions 12, 12*a*, 12*b* are molded integral with the respective wall portions 14, 14*a*, 14*b*. The method then includes releasing the food container 10, 10*a*, 10*b* from the mold. The rims 16, 16*a*, 16*b* may be molded separate from the base portions 12, 12*a*, 12*b* and wall portions 14, 14*a*, 14*b* and later affixed atop the wall portions 14, 14*a*, 14*b* through a desired adhesive. In other embodiments, the rims 16, 16*a*, 16*b* may be molded integral with the base portions 12, 12*a*, 12*b* and wall portions 14, 14*a*, 14*b*. The lids for use with the food containers 10, 10*a*, 10*b* may be molded separate, and then fit atop of the rims 16, 16*a*, 16*b* when desired. In other embodiments, another material than silicone may be used as desired, which provides sufficient strength to support the food container 10, 10*a*, 10*b* in the raised position, but also provides sufficient flexibility to allow the food container 10, 10*a*, 10*b* to bend and collapse to the collapsed position.

In closing, it is to be understood that although aspects of the present specification are highlighted by referring to specific embodiments, one skilled in the art will readily appreciate that these disclosed embodiments are only illustrative of the principles of the subject matter disclosed herein. Therefore, it should be understood that the disclosed subject matter is in no way limited to a particular methodology, protocol, and/or reagent, etc., described herein. As such, various modifications or changes to or alternative configurations of the disclosed subject matter can be made in accordance with the teachings herein without departing from the spirit of the present specification. Lastly, the terminology used herein is for the purpose of describing particular embodiments only, and is not intended to limit the scope of the present invention, which is defined solely by the claims. Accordingly, the present invention is not limited to that precisely as shown and described.

Certain embodiments of the present invention are described herein, including the best mode known to the inventors for carrying out the invention. Of course, variations on these described embodiments will become apparent to those of ordinary skill in the art upon reading the foregoing description. The inventor expects skilled artisans to employ such variations as appropriate, and the inventors intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques. Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

The terms "a," "an," "the" and similar referents used in the context of describing the present invention (especially in the context of the following claims) are to be construed to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

Specific embodiments disclosed herein may be further limited in the claims using consisting of or consisting essentially of language. When used in the claims, whether as filed or added per amendment, the transition term "consisting of" excludes any element, step, or ingredient not specified in the claims. The transition term "consisting essentially of" limits the scope of a claim to the specified materials or steps and those that do not materially affect the basic and novel characteristic(s). Embodiments of the present invention so claimed are inherently or expressly described and enabled herein.

What is claimed is:

1. A collapsible food container comprising:

a base portion defining a bottom of the collapsible food container; and a wall portion extending from the base portion and being movable between a first position and a second position in which the wall portion has a lesser height than in the first position, and including a first portion joined to a second portion at a transition, the wall portion having an inner surface and an outer surface, the inner surface configured to face towards an interior cavity of the collapsible food container when the wall portion is in the first position and the outer surface configured to face opposite the interior cavity when the wall portion is in the first position, the wall portion in the second position being moved from the first position such that the first portion of the wall portion extends upward and then downward to form an upward convex curvature portion having a maximum, and the second portion of the wall portion extends downward and then upward to form a downward convex curvature portion having a minimum, the wall portion in the first position not having a groove in the outer surface at the transition, the wall portion in the second position not having a groove or a ridge in the outer surface from the maximum of the upward convex curvature portion to the minimum of the downward convex curvature portion, and the second portion having a thickness that is greater than the first portion, and the transition forming a ridge in the inner surface of the wall portion when the wall portion is in the first position.

2. The collapsible food container of claim 1, wherein the wall portion has an upper end and a lower end that is joined to the base portion, and the upper end of the wall portion has a greater diameter than the lower end of the wall portion when the wall portion is in the first position.

3. The collapsible food container of claim 1, wherein the transition is positioned between the upward convex curvature portion and the downward convex curvature portion when the wall portion is in the second position.

4. The collapsible food container of claim 1, wherein the bottom of the collapsible food container extends in a plane, the outer surface of the wall portion passing through the plane when the wall portion is in the second position.

5. The collapsible food container of claim 1, wherein the wall portion in the first position has a dome-like shape or a pyramidal shape.

6. The collapsible food container of claim 1, wherein the first portion is adjacent the base portion.

7. The collapsible food container of claim 1, wherein the first portion is between the second portion and the base portion.

8. The collapsible food container of claim 1, wherein the outer surface of the wall portion in the first position has a downward convex curvature.

9. The collapsible food container of claim 1, wherein the wall portion is configured to bend between the first position and the second position.

10. The collapsible food container of claim 1, wherein the base portion includes a stand configured to contact a support surface at a contact surface of the stand, the contact surface defining a plane, all parts of the wall portion being above the plane when the wall portion is in the second position.

11. A colander comprising:

a base portion defining a bottom of the colander and having a plurality of holes; and a wall portion extending from the base portion and being movable between a first position and a second position in which the wall portion has a lesser height than in the first position, and including a first portion joined to a second portion at a transition, the wall portion having an inner surface and an outer surface, the inner surface configured to face towards an interior cavity of the colander when the wall portion is in the first position and the outer surface configured to face opposite the interior cavity when the wall portion is in the first position, the wall portion in the second position being moved from the first position such that the first portion of the wall portion extends upward and then downward to form an upward convex curvature portion having a maximum, and the second portion of the wall portion extends downward and then upward to form a downward convex curvature portion having a minimum, the wall portion in the first position not having a groove in the outer surface at the transition, the wall portion in the second position not having a groove or a ridge in the outer surface from the maximum of the upward convex curvature portion to the minimum of the downward convex curvature portion, and the second portion having a thickness that is greater than the first portion, and the transition forming a ridge in the inner surface of the wall portion when the wall portion is in the first position.

12. The colander of claim 11, wherein the wall portion has an upper end and a lower end that is joined to the base portion, and the upper end of the wall portion has a greater diameter than the lower end of the wall portion when the wall portion is in the first position.

13. The colander of claim 11, wherein the wall portion in the first position has a dome-like shape or a pyramidal shape.

14. The colander of claim 11, wherein the base portion includes a stand configured to contact a support surface at a contact surface of the stand, the contact surface defining a plane, all parts of the wall portion being above the plane when the wall portion is in the second position.

15. The colander of claim 11, wherein the first portion is adjacent the base portion.

16. A method of forming a collapsible food container comprising:

providing a mold;

filling the mold with silicone to form the collapsible food container including:

a base portion defining a bottom of the collapsible food container; and a wall portion extending from the base portion and being movable between a first position and a second position in which the wall portion has a lesser height than in the first position, and including a first portion joined to a second portion at a transition, the wall portion having an inner surface and an outer surface, the inner surface configured to face towards an interior cavity of the collapsible food container when the wall portion is in the first position and the outer surface configured to face opposite the interior cavity when the wall portion is in the first position, the wall portion in the second position being moved from the first position such that the first portion of the wall portion extends upward and then downward to form an upward convex curvature portion having a maximum, and the second portion of the wall portion extends downward and then upward to form a downward convex curvature portion having a minimum, the wall portion in the first position not having a groove in the outer surface at the transition, the wall portion in the second position not having a groove or a ridge in the outer surface from the maximum of the upward convex curvature portion to the minimum of the downward convex curvature portion, and the second portion having a thickness that is greater than the first portion, and the transition forming a ridge in the inner surface of the wall portion when the wall portion is in the first position; and removing the collapsible food container from the mold.

17. The method of claim 16, wherein the wall portion has an upper end and a lower end that is integrally joined to the base portion, and the upper end of the wall portion has a greater diameter than the lower end of the wall portion when the wall portion is in the first position.

18. The method of claim 16, wherein the wall portion in the first position has a dome-like shape or a pyramidal shape.

19. The method of claim 16, wherein the base portion includes a stand configured to contact a support surface at a contact surface of the stand, the contact surface defining a plane, all parts of the wall portion being above the plane when the wall portion is in the second position.

20. The colander of claim 11, wherein the transition is positioned between the upward convex curvature portion and the downward convex curvature portion when the wall portion is in the second position.

* * * * *